United States Patent [19]

Prevedini

[11] Patent Number: 4,680,906

[45] Date of Patent: Jul. 21, 1987

[54] COUPLER DEVICE FOR STRESSING CABLES, IN PRESTRESSED CONCRETE SLIDING CABLE STRUCTURES

[75] Inventor: Cesare Prevedini, Milan, Italy

[73] Assignee: Ponteggi Est S.p.A., Italy

[21] Appl. No.: 741,348

[22] Filed: Jun. 5, 1985

[30] Foreign Application Priority Data

Jun. 5, 1984 [IT] Italy ..... 22084/84[U]

[51] Int. Cl.[4] ..... E04C 5/12

[52] U.S. Cl. ..... 52/223 L; 52/230

[58] Field of Search ..... 52/225, 223 R, 223 L, 52/230, 236, 726, 698; 264/228

[56] References Cited

U.S. PATENT DOCUMENTS 4,023,242 5/1977 Roqueta ..... 52/230
4,192,114 3/1980 Jungwirth ..... 52/223 L
4,505,081 3/1985 Dinis ..... 52/223 L

FOREIGN PATENT DOCUMENTS 2360667 6/1974 Fed. Rep. of Germany ..... 52/230
2423741 11/1975 Fed. Rep. of Germany ..... 52/230
3320922 12/1984 Fed. Rep. of Germany ..... 264/228
1117114 6/1968 United Kingdom ..... 264/228
1288343 9/1972 United Kingdom ..... 52/223 R

*Primary Examiner*—John E. Murtagh
*Attorney, Agent, or Firm*—Bacon & Thomas

[57] ABSTRACT

A coupling head for structure sections of prestressed concrete comprises a body for anchorage of the strand ends relating to a first cast structure section and a plate blockable on the body for anchorage of the strand ends relating to a structure section to be subsequently cast; these second ends are enclosed within a perimeter defined by said first mentioned ends.

3 Claims, 2 Drawing Figures

Figure 1:
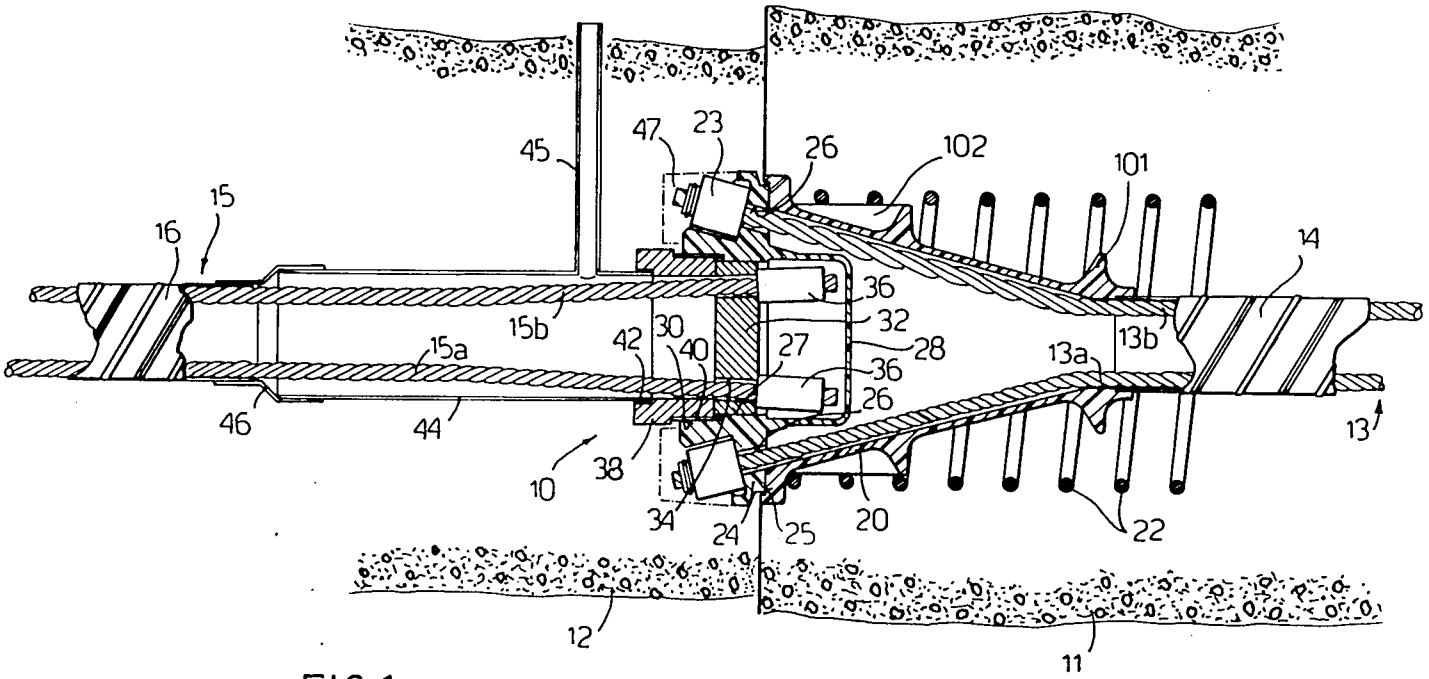

COUPLER DEVICE FOR STRESSING CABLES, IN PRESTRESSED CONCRETE SLIDING CABLE STRUCTURES

This invention relates to the manufacturing of prestressed reinforced concrete structures, particularly multi-span post-tensioned concrete structures.

When manufacturing substantially long hyperstatic reinforced concrete beams or structures by a prestress technique involving sliding or post-tensioned cables or tendons (i.e. stressing cable/s enclosed in a sheath which is embedded into the concrete), the stressing or prestress cable characteristically takes an attitude comprising curvilinear lengths or sections corresponding to the curve of the moment stresses in the beam. In order to avoid undue stress losses due to friction on the cables, according to actual manufacturing processes span or beam sections are manufactured individually and one after another, each span or beam section previously cast being individually prestressed prior to casting a next adjacent span section, on which the relative prestressing will then be carried out.

Therefore, in order to stretch the prestress cables, anchorage devices or heads are used generally referred to as "couplers", or coupling heads; a coupler provides for anchoring the "leading" or "incoming" strand ends of a prestress cable relating to a previously cast span or beam section, said cable having previously been subjected to stretching; and further provides for anchoring the "trailing" or "outgoing" strand ends of a prestress cable relating to the beam section to be cast successively.

At present various types of couplers are known, which are listed as follows.

According to a known type, a coupler or coupling head comprises a spheroidal cast iron or steel body, wherein the leading strand ends of a first cable, that is of the stretched cable relative to the first manufactured beam section, are clamped by wedge anchorages or grips (cone grips). The body has radially extended flange at an end thereof, and said flange has a lobed shape with cavities defined between the lobes; the "trailing" ends of the strands for the second cable, that is the cable for the beam section to be successively cast, are provided with swaged grips and received within the cavities between the lobes according to a circle which surrounds a circle defined by the end grips for the first strands. A protective funnel-like box or carter is arranged around the body and the swaged grips. As usual, the space in the carter and within the cable sheath is filled with cement mortar or grout after cable tensioning. A drawback of such a coupler system, is that the covering carter shall have a sufficiently large maximum diameter to cover the swaged grips of the strand ends for the second cable; therefore, it is relatively radially extended and the resistant concrete section is considerably reduced.

A further coupling device uses a body, in which the strand ends of a cable relative to a first beam section are secured by wedge grips, and on the opposite side the strand ends of a cable relative to a second beam section are preliminarly also secured by spring pressed wedge grips. By this means, the protective carter for the second beam section is of more reduced size; however, this solution has the drawback that wedges of the second span or beam section are unreliable; that is to say, once the second span or beam section has been cast, it is impossible to check whether the wedges relative thereto in the upstream anchorage have correctly operated. A further drawback is that when carrying out the injection of cement grout, the latter cannot arrive to the wedge grips for the upstream or trailing end of the cable relative to the successively cast beam section, since such cables are greased to slide in the seats thereof.

Therefore, there is in the art the need for a coupler device enabling an excellent reliable grip or anchorage both for the ends of the cables relative to the first cast section, and for the ends of the cables relative to the successively cast section, but which can be protected by a carter of reduced dimensions.

It is the object of the present invention to meet the above mentioned requirements.

Such an object has been achieved by an anchorage or coupler device or head comprising a first element with a radially extended anchoring flange, having circumferentially spaced apart seats for accommodating grips generally wedge grips, for the ends of strands relating to a first cast beam section; a second element comprising circumferentially spaced apart seats for accommodating grips (generally swaged grips) for the first ends of strands relating to a successively cast beam section; the strand ends relating to the previously cast section being outside the strand ends relating to the successively cast section. Generally, the first element is arranged against a shoulder of a cast iron funnel or guide incorporated in the previously cast section. Said first element also comprises a box-like housing for receiving the second element and the ends of the strands relating to said successively cast section, so as to separate the same with respect to the internal space of the guide. The second element preferably comprises also a threaded ring nut that can be screwed down on the thread of the first element in order to clamp in place the plate of the second element within the housing of the first element. As preferred, said plate may have said seats for the strand ends in form of through holes or in form of radial lobes. A protective carter is mounted on said ring nut.

The novel device has the advantage of requiring a protective carter of extremely reduced diametrical dimension, substantially coincident with the diameter of the sheath containing the strands of the cable relating to the successively cast beam section; it also allows a very easy injection of the cement grout; finally, it provides a superimposition or "covering" between the strands relating to the previously cast section and the strands relating to the successively cast section (that is to say, a projection on a longitudinal axis of the strands of the second section and a projection on same axis of the strands of the first section have a common portion).

Figure 2:
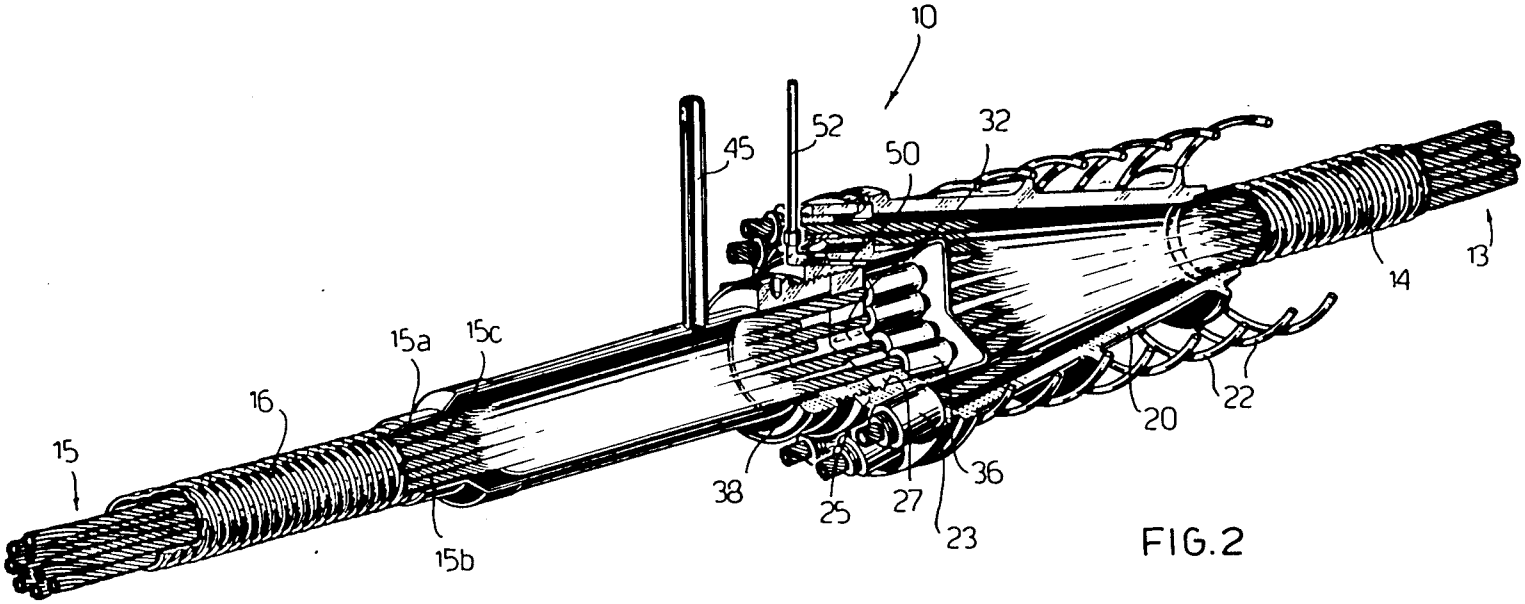

A particular embodiment of the invention will be hereinafter described by mere way of unrestrictive illustration, with reference to the accompanying drawings, in which:

FIG. 1 is a longitudinal sectional view along an assembled coupling device or coupler; and FIG. 2 is a perspective partially broken-away view of the assembled device.

In FIG. 1, reference numeral 10 denotes a coupling device as a whole (hereinafter also referred to as coupling head or coupler); reference numeral 11 is a first-cast concrete beam section, which has been cast in accordance with sliding cable prestress techniques; reference numeral 12 is a second-cast concrete beam section, which has been cast successively to section 11 and is adjacent thereto. Reference numeral 13 denotes a prestress or stressing cable relating to section 11, wherein 13*a*, 13*b*, etc. are cable strands, and 14 is a cable sheath. Reference numeral 15 denotes a prestress cable for the successively cast section 12, wherein 15*a*, 15*b*, etc. are cable strands, and 16 is a cable sheath.

A funnel or guide 20 of the device is incorporated in an end portion of beam section 11; said guide is generally made of cast iron, and has axially spaced apart circumferential tabs or fins 101 for an improved holding in the concrete. A conventional reinforcement 22 is drawn about the funnel and is supported and positioned relative to the funnel by radial tabs of fins 102.

The inventive device 10 also essentially comprises a first element or body 24, generally of substantially circular section, having a shoulder surface 25, substantially orthogonal to the device axis, and seats 26 for the strands, said seats being preferably arranged on a circle centered on the device axis and having their axes slanting with respect to the device axis, to define a not necessarily circular cone. Said body 24 also has a central aperture defined by a wall 27 and a box-like extension or casing 28. A threaded surface 30 is adjacent said wall 27. A hole 50 (FIG. 2) may be provided between a surface around said aperture 27 and the inside of said casing 28 for connection to a small tube 52, the latter serving for air vent or bleed as the cement grout is injected into the casing 28.

The head 10 further comprises a grip bearing plate element 32 having an outer size suitable to be received within a housing defined by wall 27 against said wall. This plate 32 has seats 34 to receive the ends of strands 15*a* and 15*b*. In the embodiment shown in the accompanying drawing, said seats 34 comprise through holes, which may be variously arranged in the plate, that is they may be arranged on a circle, or on a plurality of concentric circles, or in any desired manner. According to a modified embodiment (not shown), the seats may comprise lobe-like cavities arranged on a circle; however, in such a case, a spacer (not shown) may be required to maintain the strand ends spaced apart from one another. Generally, said ends are clamped by swaged grips 36. The device further comprises a ring nut 38, having a threaded surface 40, for fitting on said thread 30 of the body element. Said ring nut 38 clamps the grip bearing plate 32 within said body 28. At an axially outer end and radially inner end of the ring nut, an offset 42 receives a protective carter 44 which, as shown, has a substantially small diametrical size, which is just slightly larger than the diametrical size of the cable sheath. According to a per se known technique, said carter 44 has a small air vent tube 45, through which air will exit when cement grout is being injected into the carter. Said carter is connected to sheath 16 by a connector 46 at its end opposite to the ring nut.

Upon casting of the first span or beam section 11 incorporating said guide 20, and after curing, the ends of strands 13*a*, 13*b*, etc. emerging from the sheath are slipped or introduced into the body element 24 of the head and said body is positioned on the guide, arranging the strand ends within the seats 26. The strands are individually simultaneously stretched and clamped by wedge grips 23. The injection of cement grout is carried out by a box means 47, shown by dashed dot line, and through the gaps between said seats 26 and strands 13*a*, 13*b*, etc. into a space defined within said sheath 14 and guide 20. The plate 32 is then positioned and has anchored thereon the "beginning" or "trailing" ends of strands 15*a*, 15*b* etc. relating to the beam section to be successively cast; then said plate is clamped by said ring nut 38. Then the carter 44 is connected to the ring nut and sheath.

Of course, all of those changes in the range of those skilled in the art can be made, without departing for this from the field defined by the present application.

What I claim is:

1. A coupler device for sliding cable prestressed concrete structures for anchoring the leading strand ends of a prestress cable of a previously cast beam section and the trailing strand ends of a prestress cable of a subsequently cast beam section, which device comprises a first element including seats for receiving grips carried by the leading strand ends and a casing defining an internal space for enclosing the trailing strand ends, a second element including seats for receiving grips carried by the trailing strand ends, means for clamping the first and second elements together, the seats carried by the grips of the trailing strand ends being enclosed within a space defined by the axes of the seats for the grips for the leading strand ends, and the first element including a through hole between an outer surface thereof and the internal space defined by the casing for venting air during injection of cement grout.

2. A coupler device for sliding cable prestressed concrete structures for anchoring the leading strand ends of a prestress cable of a previously cast beam section and the trailing strand ends of a prestress cable of a subsequently cast beam section, which device comprises a first element including seats for receiving grips carried by the leading strand ends, a second element including seats for receiving grips carried by the trailing strand ends, the first element being provided with a threaded portion, a clamping ring nut having a threaded portion engageable with the threaded portion of the first element for clamping the first and second elements together, and the seats for the grips carried by the trailing strand ends being enclosed within a space defined by the axes of the seats for the grips carried by the leading strand ends.

3. The coupler device of claim 2 wherein the clamping ring nut includes an offset disposed in an axially outer and radially inner edge thereof for receiving one end of a protective carter.

* * * * *